United States Patent [19]

Edgington et al.

[11] 4,077,137

[45] Mar. 7, 1978

[54] GRAPHIC ARTS FILM DRYER

[76] Inventors: Donald C. Edgington; William E. Edgington, both of 2425 N. Ashland Ave., Chicago, Ill. 60614

[21] Appl. No.: 659,005

[22] Filed: Feb. 18, 1976

[51] Int. Cl.[2] ..... F26B 19/00

[52] U.S. Cl. ..... 34/70; 34/155; 34/160; 226/186; 226/189; 226/195

[58] Field of Search ..... 34/70, 71, 155, 95, 34/66, 160, 161; 226/195, 186, 189

[56] References Cited

U.S. PATENT DOCUMENTS

| | | | |
|---|---|---|---|
| 3,660,911 | 5/1972 | Buckingham | 34/155 |
| 3,724,243 | 4/1973 | Calamari, Jr. et al. | 34/71 |
| 3,797,127 | 3/1974 | Yamada et al. | 34/155 |
| 3,895,450 | 7/1975 | Hope et al. | 34/155 |

FOREIGN PATENT DOCUMENTS

| | | | |
|---|---|---|---|
| 2,120,056 | 11/1971 | Germany | 34/155 |

*Primary Examiner*—Kenneth W. Sprague
*Assistant Examiner*—James C. Yeung
*Attorney, Agent, or Firm*—Paul H. Gallagher

[57] ABSTRACT

A film dryer for the graphics arts, including a plurality of pairs of squeegee rollers feeding the film through the dryer, and removing water therefrom in the feeding operation. Air is drawn in and directed against the film to dry the film, the air passing through a series of chambers or spaces and passing over and cooling the drive motor and air circulating motor, the heat in the air, picked up from the motors, assisting in drying the film. The pairs of rollers are of successively greater diameters to progressively feed the film faster to keep the film taut and eliminate buckling thereof. The relatively great volume and distribution of spaces through which the air passes minimizes noise. The principal operating components are included in assemblies which are individually removable as units, for ease in servicing, such as a roller assembly which includes air tubes, drive motor assembly, blower-motor assembly, cover, feed roller, and drain pan. Additionally, breakaway clips are included, being positioned between end-butted sections of the rollers, that are individually removable from the rollers without disassembling any of the rollers or positions thereof.

20 Claims, 9 Drawing Figures

GRAPHIC ARTS FILM DRYER

PERTINENT PRIOR ART

U.S. Pat. No. 3,557,469, dated Jan. 26, 1971, issued to the present Donald C. Edgington;

U.S. Pat. No. 3,800,434, dated Apr. 2, 1974, issued to the present inventors.

FIELD OF THE INVENTION

The invention resides in the general field of graphic arts, and particularly a dryer for drying film. The above two identified patents relate to the general kind of film dryer concerned herein and the present invention includes improvements over the devices of those patents. This kind of dryer includes a plurality of pairs of squeegee rollers, and the film to be dried is introduced between the rollers of the pairs and then passing from one pair to the next, the rollers then squeegeeing the water from the film, air being directed against the film for assisting in the drying operation. Breakaway clips are included in association with the rollers to prevent the film from wrapping around the rollers, and to guide and direct the film in a plane passing between the rollers of the pairs. The dryer includes a motor for driving the rollers, and a motor-blower for developing an air stream and directing the air onto the film.

OBJECTS OF THE INVENTION

A main and broad object of the invention is to provide a novel graphics arts film dryer of the foregoing general character.

Another and broad object is to provide a film dryer having a novel mechanical construction greatly facilitating removal of various components and parts from the dryer, correspondingly facilitating servicing.

Another object is to provide afilm dryer having a novel arrangement having driving means for feeding film through the dryer, and driving means for developing an air current, and having the advantage that the air is drawn or blown over the driving means for cooling them, and the air picked up in the cooling step assists in drying the film.

Another object is to provide a film dryer that is unusually quiet in operation.

A more specific object is to provide a film dryer wherein the utilized in the cooling and drying steps, passes through spaces of substantial size and distribution whereby to effectively insulate the noise of operation of the device.

Another object is to provide a film dryer wherein the air utilized in cooling and drying passes through interior passages of the motors which develops the air passage, whereby to efficiently cool those motors.

A further object is to provide a film dryer having a novel construction and arrangement of spaces and chambers, wherein at one stage, air pressure of substantial magnitude is developed for effectively directing it onto the film in the drying step, and the construction of the dryer includes a special strengthening feature against air pressure, whereby to enable utilization of a simple construction.

Another object is to provide a film dryer of the foregoing character which, because of its unusual effective drying operation, can be made with fewer squeegee rollers, and thereby be more simple and less expensive for a given drying operation.

A further object is to provide a film dryer having effective squeegee roller arrangement so as to remove the greater quantity of the water as a first step in the drying operation.

Still another object is to provide a film dryer of unusually simple construction, including a novel design enabling various components and parts to be removed from the dryer as a whole, which includes such items as a drip pan, and cover, which, individually and together, tend to confine and direct the air in the area of the film to effect passage of that air along the direction of its feeding through the dryer, to increase the drying operation.

Another and more specific object is to provide, in a film dryer, novel squeegee rollers and breakaway clips, the clips preventing the film from wrapping around the squeegee rollers, wherein the clips are of novel construction and form, to facilitate removal of the clips from the rollers, and further to enable removal of the clips without disassembling any of the rollers, or components in which the rollers are incorporated.

A still further object is to provide a film dryer having a series of pairs of squeegee rollers for feeding the film through the dryer in a drying operation, wherein the successive rollers are driven at progressively increased peripheral speeds whereby to increase the feeding speed of the film as the film passes through the dryer, to prevent buckling or otherwise misshaping of the film.

DESCRIPTION OF A PREFERRED EMBODIMENT:

Figure 1:
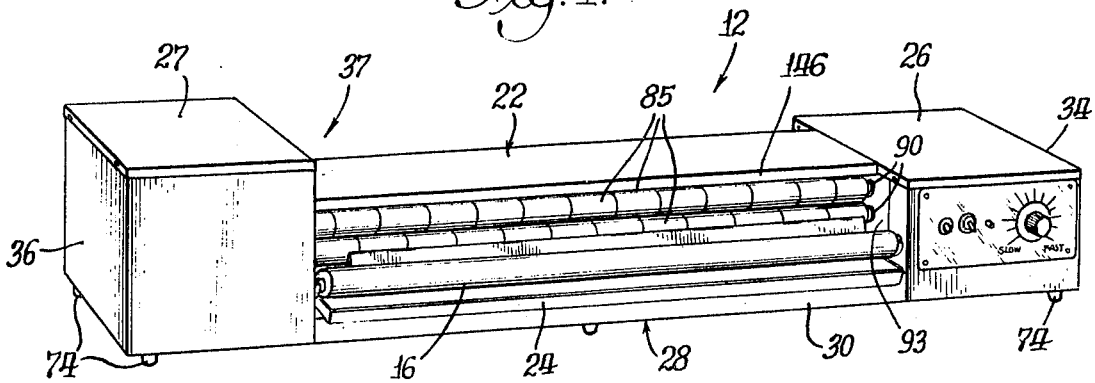
FIG. 1 is a perspective view of a film made according to the present invention.

Referring in detail to the drawings, the dryer as a whole is indicated in its entirety at 12, and includes as its main components and parts, a frame 14, a roller assembly 16, a drive motor assembly 18, a motor-blower assembly 20, a cover 22, a drip pan 24, a feed roller 25, and end top closure plates 26, 27. These components and parts are mutually separable from each other and individually removable from the dryer as a whole, as will be described in detail hereinbelow.

Figure 2:
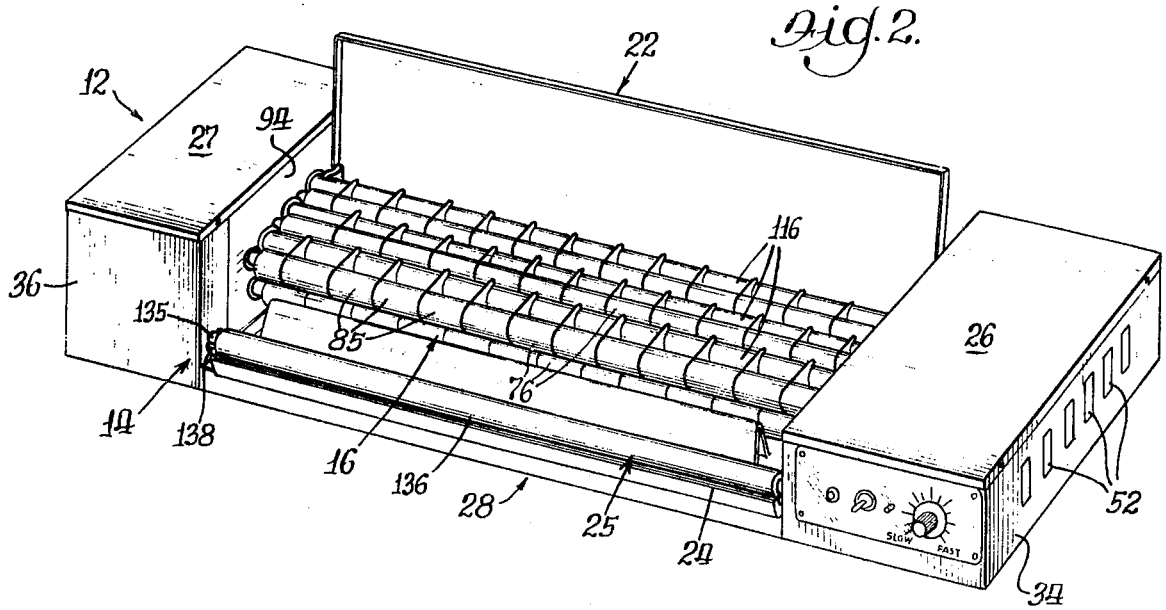
FIG. 2 is a perspective view of the dryer with the cover in open position, taken from a different angle from that of FIG. 1.
Figure 4:
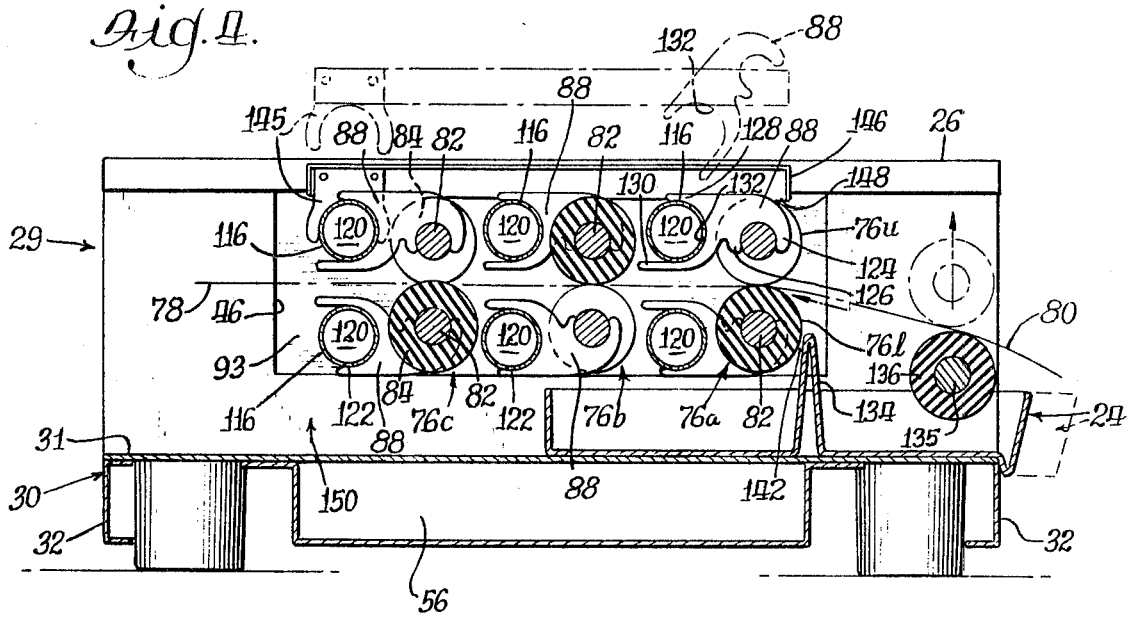
FIG. 4 is a transverse vertical sectional view of the dryer, taken at line 4—4 of FIG. 3.
Figure 3:
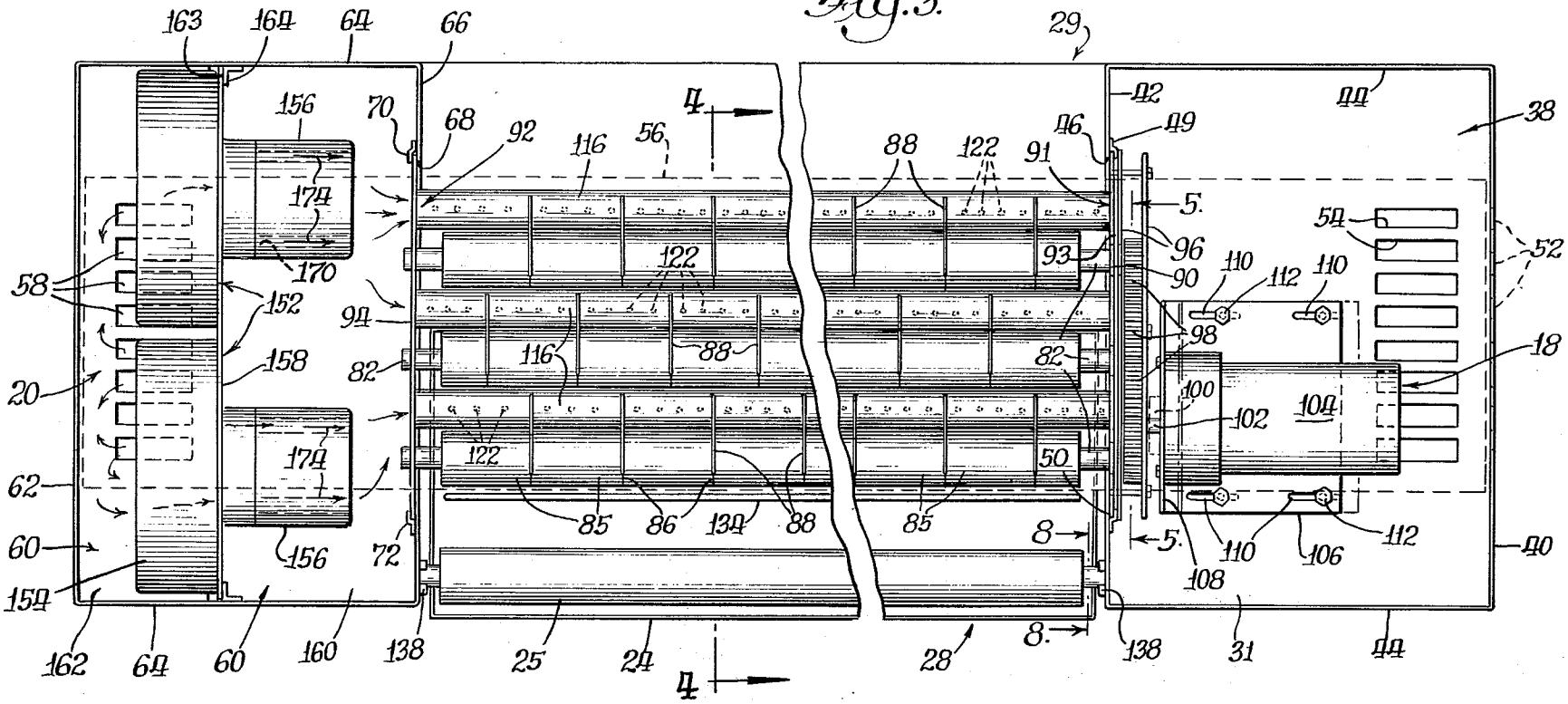
FIG. 3 is a top plan view of the dryer with the cover and the top closure plates at the ends removed.

The dryer is generally elongated transversely, having a front or entry side 28 facing the observer in FIGS. 1 and 2, and also shown in FIGS. 3 and 4, and an opposite rear or exit side 29, these orientations corresponding with the passage of the film through the dryer.

The frame 14 may be of sheet metal pieces suitably secured together, including a base element 30 which may be generally similar to an inverted tray or pan which has an element 31 serving as a floor or bottom element to the dryer as a whole. The base includes a surrounding downturned flange 32.

Figure 6:
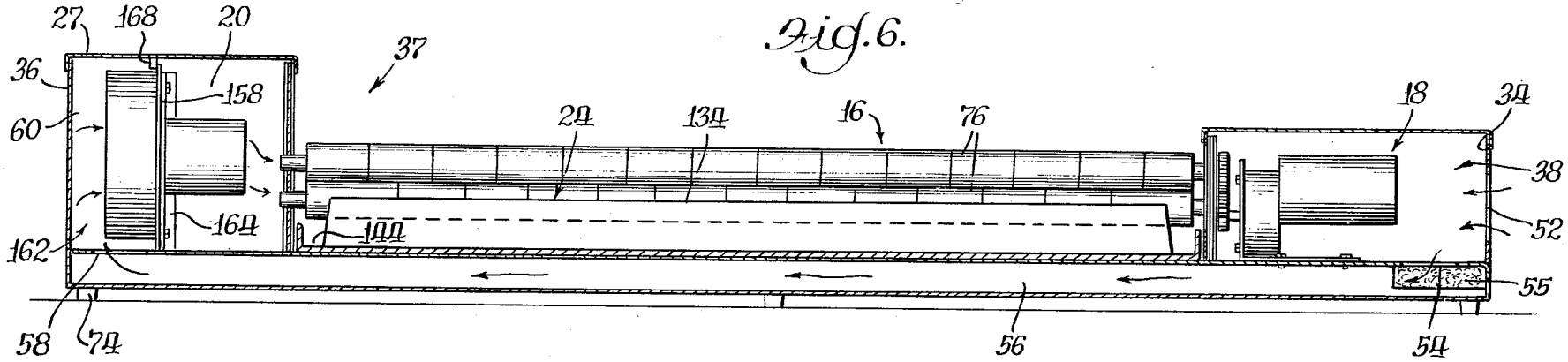
FIG. 6 is a longitudinal vertical sectional view, somewhat diagrammatic in nature, omitting various details.

The frame 14 is provided with upstanding boxes 34, 36 at the right and left sides in the orientation of FIGS. 1, 2 and 6, and a valley or cavity 37 therebetween. The box 34 defines a chamber or well 38 in which the drive motor assembly 18 is positioned, the details of which are described hereinbelow. The box 32 includes an outer wall 40, an inner wall 42, and front and rear walls 44. The inner wall 42 is provided with a notch or cut-out 46 for cooperation in mounting the roller assembly 16 as described hereinbelow, the marginal edges of this notch 48 having flanges 49 secured thereto as by spot welding, forming grooves 50 for receiving a plate of the roller assembly. The outer wall 40 is provided with apertures or holes 52 for intake of air and the floor element 31 is provided with apertures or holes 54 (FIG. 3), below which is a suitable filter 55; the apertures 54 lead to a conduit, or air transfer or tunnel 56 which as viewed in FIG. 4 is of substantial width, on the under side of the floor element. The substantial width of the conduit enables it to be relatively shallow and still provide the desired air flow capacity, this factor being of significance in the noise insulation feature and compactness of design. The air transfer or conduit 56 continues to the opposite or left end of the frame where it opens through similar apertures or holes 58 into the chamber or well 60 formed by the box 36, this box having an outer wall 62, front and rear walls 64, and an inner wall 66. The inner wall is provided with a notch or cut-out 68 for cooperation with a plate in the roller assembly 16 as referred to again hereinbelow, this inner wall also having flanges 70 secured thereto as by spot welding around the marginal edges of the notch, forming grooves 72 for directly receiving the plate mentioned in the roller assembly. The cavity 37 and the chambers 38 and 60 form what may be referred to generically as stations.

The base of the frame is provided with a plurality of legs 74 of resilient material, longer than the depth of the flanges of the base and the conduit 56, for supporting the entire weight of the dryer.

The roller assembly 16 includes a plurality of rollers 76, arranged in pairs 76*a*, 76*b* and 76*c* spaced along or progressing from front to rear, and each pair includes an upper roller 76*u* and a lower roller 76*l*. The rollers of the respective pairs effectively engage in a film plane 78 disposed horizontally and extending from front to rear, this film plane constituting the locus in which the film passes through the dryer. A film to be dryed is indicated at 80, and it will be seen that the forward or leading edge is fed to the nip or bight of the first pair of rollers, and thus disposed substantially in the film plane 78, while the trailing portion extends forwardly.

Each roller 76 includes a central shaft 82 and a sleeve or sheath 84 on the shaft secured thereto in any suitable and known manner. The sleeve or sheath is preferably of rubber or similar resilient and high friction material. The sleeve is made up of a plurality of axially aligned and butted sections 85, forming slits 86 for receiving breakaway clips 88, these clips to be referred to again hereinbelow.

The shafts 82 are fitted in bearings 90 of suitable kind incorporated in stations 91, 92 which include end plates 93, 94 respectively, which in turn are fitted in the grooves 50, 72 identified above, in substantially airtight fashion filling the corresponding notches for effective control of air through the dryer.

Figure 5:
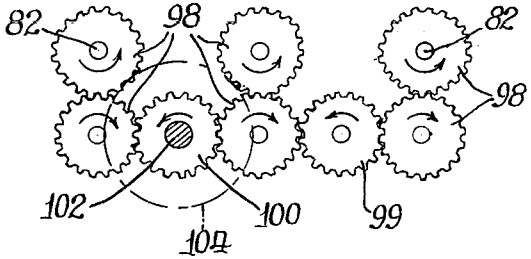
FIG. 5 is a detail view of the driving gearing, taken at line 5—5 of FIG. 3, partially diagrammatic in nature.

At the right hand end of the roller assembly (FIG. 3) additional plate elements or mounting elements 96 are provided for mounting the corresponding ends of the roller shafts 82 and to mount and confine the gears 98, these gears including (FIG. 5) one on each of the shafts and are in mesh with each other either directly or through an idler 99 and a drive gear 100, the latter mounted on the drive shaft 102 of a motor 104 in the motor assembly 18. This motor assembly includes a base 106 with a flange 108 and having elongated slots 110 through which bolt means 112 extend. Upon loosening the bolt means, the motor can be shifted to the right (FIGS. 3 and 6) to inactive position, and in such position the drive gear 100 is withdrawn from operative engagement with the other gears 98. Upon removal of the nut means on the bolt means the motor assembly can be bodily withdrawn from the chamber.

Referring particularly to FIG. 4, the rollers 82 increase in diameter successively through the dryer from front to rear, i.e., the rollers 76*b* are slightly larger than the rollers 76*a* and the rollers 76*c* larger than the rollers 76*b*. Each increase in size is on the order of 0.020 to 0.040 inch in diameter. The peripheral speed is increasingly greater corresponding to increase in size, and the rollers are all driven at the same angular speed. The increase in peripheral speed may instead be produced by having the rollers driven at a great angular speed but the present arrangement is preferred whereby the rollers in each the upper and lower position can be placed in a common axial plane.

Figure 9:
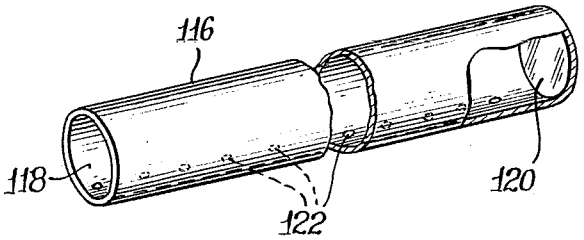
FIG. 9 is a perspective view of a fragment of an air tube utilized in the dryer.

Incorporated in the roller assembly 16 also are air tubes 116. A fragment of one such tube is shown in perspective in FIG. 9, having an open end 118 and a closed end 120, and a plurality of apertures 122 spaced longitudinally therealong. The tubes are mounted between each two successive rollers in each the upper and lower groups, and rearwardly beyond the last of those rollers. The tubes are fixedly mounted and supported in the plates 93, 94, with their open ends communiating with the chamber 60. The apertures are directed toward the film plane 78, i.e., in the upper series downwardly and in the lower series upwardly, for directly impinging the air onto the film. Preferably the total open area of the apertures in one tube is about 10% less than the cross sectional area of the tube itself, to provide the desired back pressure for producing substnatially uniform air pressures through the apertures.

The breakaway clips referred to above are best shown in FIG. 4. Each clip is generally flat, preferably a plastic molded piece, having a hook formed by fingers 124, 126 fitted over the roller shaft 82. The fingers form an arcuate recess of slightly more than 180°, and frictionally hold the clip on that shaft, but enable the clip to be snapped off. At the other end the clip has fingers 128, 130 surrounding the adjacent air tube 116, defining a recess 132 having an arcuate curvature of 180°, and extending parallel beyond that point to enable the clip to be applied to and removed from active position. Also in FIG. 4 is an indication of the clip in detached position, the end at the roller is pulled upwardly either by the operator's fingers or by a hook under it, and that end raised toward the angular position shown in dot-dash lines, and the other end then easily withdraws from the air tube. The clip is replaced into active position in a similar manner in reverse direction. The clips at their first ends are fitted in the slots 86. The sections of the roller normally abut each other and they yield axially to receive the clips, but beyond the area where the clip is positioned, the roller sections tend toward each other and again interengage, and this interengagement extends for example approximately two-thirds of the circumference (FIG. 4) and particularly the portion at the film plane that engages the counterpart roller of the pair. Thus the surface of the roller that engages the film in feeding the film through is effectively continuous axially. The slits although nearly non-existent, may leave a very fine line of water on the film, and for this reason the clips are staggered both in direction from front to rear (FIG. 3) and as between the upper and lower rollers (FIG. 6).

Figure 8:
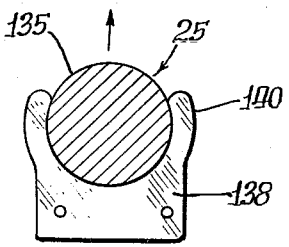
FIG. 8 is a detail view taken at line 8—8 of FIG. 3.

As the film passes through the dryer, most of the quantity of water on the film is removed by the first pair of rollers 76*a*, and to catch the water the drip pan 24 is utilized. This drip pan may be molded plastic and includes an internal transverse baffle or wall 134. The drip pan is removable as indicated above, and merely slid into and out of position, when the feed roller 25 is out of position. This feed roller preferably also includes a shaft 135 and a sheath 136 of resilient material. The feed roller is mounted in clips 138 (FIGS. 3 and 8) with fingers 140 defining an upwardly opening socket for receiving the shaft, the fingers extending slightly more than 180° for normally frictionally retaining the shaft in the socket. When the feed roller is out of position, as stated, the drip pan is easily removable and re-inserted into place. The feed roller 25 removes a portion of the water on the film, the roller being above the pan for that purpose and it also holds the film upwardly from contact with the front edge of the drip pan.

The baffle or wall 134 in the drip pan is of substantial height, being spaced from the roller 76*i* a small distance as indicated at 142 for minimizing air escape at that position as referred to again hereinbelow. The baffle 134 does not extend the full width of the pan, leaving gaps 144 for enabling water inwardly of that baffle to flow outwardly to the front portion of the drip pan.

The cover 22 is preferably a piece of sheet metal and provided with clips 145 (FIG. 4) removably fitted over the rearmost air tube 116. These clips enable the cover to hinge and also to be removed by merely snapping them off of the air tube. The cover may have a surrounding down turned flange resting on the plates of stations 91, 92 supporting the cover in closed position. The flange includes a front element 146 (FIG. 4) which is closely adjacent the upper front roller 76*u* leaving a small space 148 also restricting flow of air therepast and directing it toward the rear.

Upon flow of air through the air tubes, the air passing out of the apertures 122 is directed onto the film, and this air is for the greatest part, in the area around the rollers, directed to the rear. The cover flange element 146 and the baffle 134 prevent the escape of great amounts of air to the front, and the air then flows rearwardly and most of it passes out the rear, through the spaces around the rearmost air tubes 116 and the large space 150 below the roller assembly.

Figure 7:
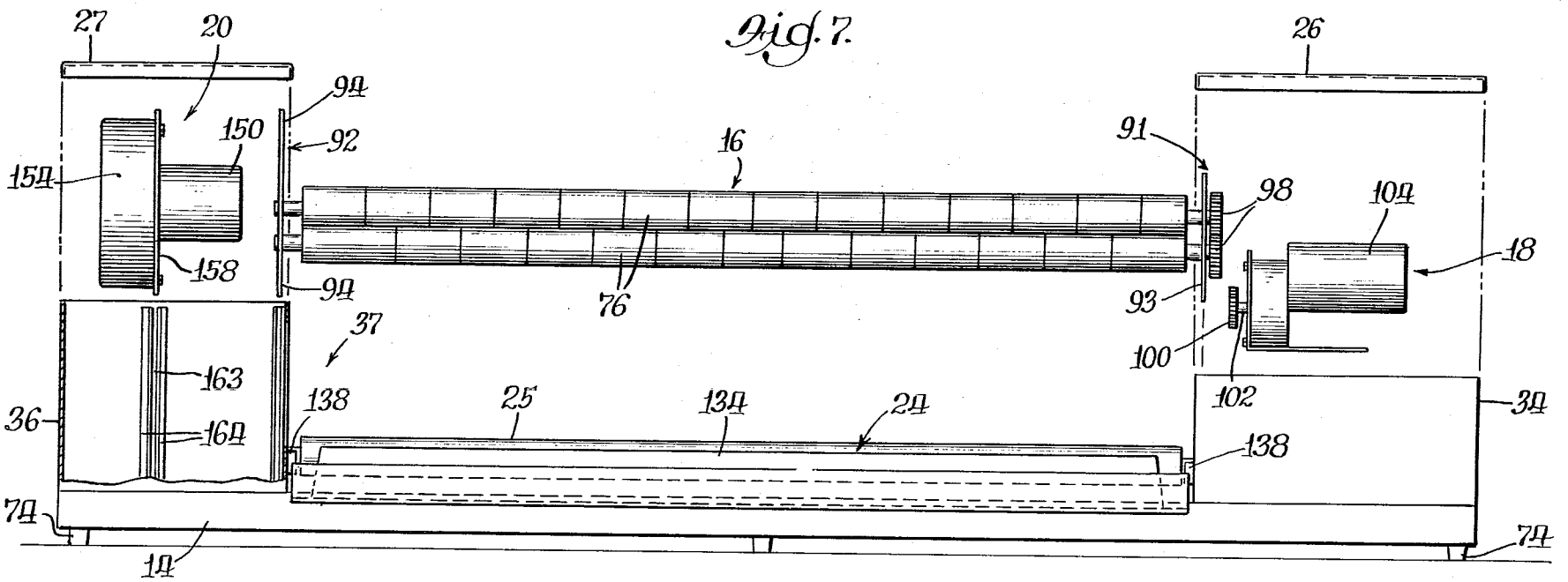
FIG. 7 is a side elevational view somewhat diagrammatic in nature, omitting details, and showing parts in exploded position.

The motor-blower assembly 22 includes preferably two units 152 each including a blower 154 and a motor 156 mounted together on a mounting plate 158, dividing the chamber 60 into two sub-chambers or spaces 160, 162. The plate 158 is removably fitted in grooves 163 formed by flanges 164 on the sides and bottom (FIGS. 3 and 7). The sub-chambers 160, 162 are substantially airtight-separated and the top closure plate is removably placed over the box to close the sub-chambers, and the closure plate is provided with a flange 168 which engages the upper edge of the plate 158 holding the mounting plate against the pressure developed in the sub-chamber 160, i.e., against movement to the left (FIGS. 3 and 6). The motors 156 are provided with annular spaces 170 between the rotor and the stator, and air is forced therethrough as indicated by the arrows 174, by the blowers, more effectively cooling the motors.

In the operation of the device the motor-blower units 152 operate to draw air from the exterior through the apertures 54 at the right end (FIGS. 3 and 6), over the gears and motor, cooling those components and picking up heat therefrom. The air is then drawn through the apertures 54 and the filter 55, into the conduit 56 to the opposite end, and then through the apertures 58 into the sub-chamber 162. The blowers then force the air into the sub-chamber 160, and pressure is built up therein. This pressure then tends to deflect the plate 158 as stated, but the plate is restrained by the flanges 164, 168. The air is then forced into the air tubes 116 and because of the relative constriction by the apertures in the tubes, the air is forced out of the apertures at a relatively high rate onto the film. It will be understood that the top closure plates 26, 27 fit the boxes 34, 36 in airtight engagement.

The air circulated through the dryer and picking up heat from the motors and gears becomes unusually effective in drying the film. The greater volume of spaces through which the air passes, including the chamber 38, 60 — and the air transfer 56 produces an unusually effective insulation against noise, these spaces occupying a relatively great portion of the total dimensions of the dryer, such for example as at both sides (ends) and below. The air transfer 56 produces great noise insulation, and because of its great width it can be very shallow, this arrangement adding to the compactness and simplicity of the overall construction.

The construction of the dryer is unusually simple; the operating components can be easily removed from the whole dryer; upon removing the top closure plates 26, 27, the drive motor assembly 18 can be retracted (FIG. 6) and then the roller assembly 16 removed; this can be removed with the cover still applied thereto, or the cover itself can be removed from the assembly; the drive motor unit 18 can also be removed; the motor-blower assembly 20 can be removed as a unit; the drip pan 24 can be removed, after removal of the feed roller 26, and all that remains is the rigid unitary frame. Thus the dryer can be easily serviced, an advantage in addition to the simplicity and relative economy in manufacture.

Additionally the breakaway clips 88 can be individually removed from the roller assembly, without removing the rollers from the roller assembly and of course without in any way taking apart any of the rollers themselves.

We claim:

1. A film dryer comprising a frame having boxes at the sides thereof defining chambers therein, a roller assembly mounted on the frame between the said boxes and including rollers for feeding a film through the roller assembly and squeegeeing water from the film, means for driving the squeegee rollers, mounted in one of said chambers, means for producing an air stream, conduit means in the roller assembly for receiving air from said air stream and directing it onto a film in the roller assembly, the air stream producing means being mounted in another of said chambers, the dryer including a conduit on the underside of the frame communicating between the chambers for conducting air from one of the chambers to the other, the arrangement thereby including air spaces of substantial volume on three sides, namely the opposite sides of the dryer and under the frame, whereby to provide substantial insulation against noise from the operation of the dryer.

2. A film dryer according to claim 1 wherein said conduit includes a tunnel of substantial width from front to rear and of shallow depth, whereby the depth may be of minimum dimension while still providing substantial air-flow capacity resulting in relatively compact and simple construction of frame.

3. A film dryer according to claim 2 including means for driving the rollers and the means for producing an air stream to the rollers and are in respective ones of the chambers, and the air passing through the dryer passes over both of said motors, picking up heat therefrom and effectively cooling the motors, and the relatively heated air is directed onto the film and aids in the drying operation thereof.

4. A film dryer according to claim 3 wherein the means for developing said air stream includes motor-blower units in a second of the chambers, said motor-blower units being mounted on a plate removably placed in said second chamber and separating it into separate sub-chambers, the blower component of the motor-blower unit being in one of these sub-chambers and blowing air into the second of the sub-chambers, whereby the air in the second sub-chamber is of relatively greater pressure, thereby tending to force said plate into the first sub-chamber, the frame including a top closure plate for the second chamber removably mounted thereon, and said closure plate includes a flange engageable by the closure plate, when the closure plate is in position on the box, supporting said plate against displacement by the greater pressure in the second sub-chamber.

5. A film dryer according to claim 4 wherein the motors of the motor-blower unit are on the side of the plate opposite the blowers and have interior passages therethrough, and the construction and arrangement are such that the air stream is driven by the blowers through said interior passages for cooling the motors.

6. A film dryer according to claim 4 wherein the air conduit means in the roller assembly includes tubes communicating with said second sub-chamber whereby the air under pressure flows into the tubes, and the tubes have apertures for directing air onto a film passing through the roller assembly, and the total area of said apertures in each air tube is less than the total cross-sectional internal area of the air tube itself.

7. A film dryer comprising, a frame having front and rear sides and including a common floor providing a plurality of transversely spaced stations thereon, a plurality of pairs of squeegee rollers, each pair including an upper roller and a lower roller respectively above and below a film plane, air conducting means for receiving air and directing it onto a film in the film plane, the rollers and air conducting means being included in a self-contained roller assembly, the roller assembly being mounted in the frame in a first of said stations with the film plane positioned horizontally and extending from front to rear, the roller assembly being insertable in and removable from said first station as a unit, a drive motor included in a self-contained assembly mounted in the frame in a second of said stations, and being so mountable therein and removable therefrom as a unit, and having detachable driving connection with the rollers, and motor-blower means for impelling air through the air conducting means, and included in a self-contained unit mounted in a third of said stations, and being so mountable in and removable from its said station as a unit, and having detachable operable connection with the air conducting means, each of said self-contained units being mountable in and removable from their respective stations in upward directions, and thereby, because of the transverse spacing of the stations, being so mountable and removable each independently of each of the other units, and without interference with either of the other units,

8. A film dryer according to claim 7 wherein the dryer is elongated transversely and has relatively shorter dimension from front to rear, the frame includes boxes at the sides of defining chambers therein which form said second and third stations respectively, and the boxes define a valley therebetween which forms said first station.

9. A film dryer according to claim 7 wherein the air conducting means includes a plurality of air tubes respectively interspersed with adjacent rollers both above and below the film plane and having apertures for directing air streams passing therethrough onto a film in the film plane.

10. A film dryer according to claim 9 wherein said air tubes communicate with the chamber in the box at the third station, the box at the third station is provided with a closure plate confining the chamber in the box except for an intake opening and openings forming communication with the air tubes, the motor-blower means is confined in such confined chamber and such positioning of the motor-blower means and the communication between the chamber and air tubes constituting the operable connection between the motor-blower means and the air conducting means.

11. A film dryer according to claim 10 wherein the box at the second station is provided with a closure plate confining the chamber except for an intake opening and an opening forming communication with the chamber in the box at the third station, the motor-blower means operatively drawing air from the chamber in the box at the second station and impelling it into the air tubes, said boxes have interfacing walls at the sides of the valley, said walls having notches therein and the roller assembly having outer plates fitted in said notches whereby those walls support the roller assembly and said plates effectively close the notches against the passage of air therethrough.

12. A film dryer according to claim 8 and including a cover over said roller assembly, said cover substantially closing the upper side of said valley over the rollers in the assembly, and cooperating with the rollers in confining air from the roller assembly substantially against escape to the front and directing the air toward the rear for escape in that direction.

13. A film dryer according to claim 12 wherein the cover is mounted on the roller assembly and supported thereby, and is carried by the roller assembly in the movements of the latter in being mounted in and removed from the frame, the cover is also mounted on the roller assembly for swinging hinged movement, and detachably mounted thereon for removal therefrom.

14. A film dryer according to claim 12 and including a drip pan on the floor of the frame and extending substantially the full width of the valley thereof and having a baffle cooperating with the rollers in the roller assembly for confining air from the roller assembly substantially against escape to the front and directing it rearwardly for escape in that direction, said drip pan also having a portion under at least certain of the rollers for receiving water squeegeed from the film.

15. A film dryer according to claim 14 and including a feed roller removably mounted on the frame in a position over the drip pan and in front of the rollers of the roller assembly, said feed roller extending higher than the frontmost element of the drip pan for supporting the trailing portion of a film, being fed to the rollers, above the frontmost edge of the drip pan.

16. A roller assembly for incorporation in a film dryer comprising, a plurality of pairs of rollers, each pair including a roller above and below a common film plane, the pairs of rollers being distributed along the film plane from a front side to a rear side, the rollers in the assembly being operative for feeding a film in said film plane between rollers of a pair to those of each successive pair, each roller including a shaft and a sleeve of resilient and frictional material, the sleeve being formed of a plurality of axially aligned and butted sections leaving slits between adjacent sections, and a plurality of breakaway clips, one clip having a first end positioned in each of said slits and a second end extending radially beyond the sleeve in the direction of the film plane, the roller assembly including means for supporting the second ends of the clips, such clips having edges adjacent said film plane for confining the film being passed between the rollers against wrapping around any of the rollers, each clip having an open-ended recess at each the first end and the second end of the clip, the recess at the first end receiving the shaft of the corresponding roller and the recess at the second end receiving the corresponding supporting means, the clips being detachably mounted in position, and each being removable therefrom by withdrawing the first end in direction opposite the open end of the recess therein, and withdrawing the second end from the corresponding supporting means in direction opposite the open end of the recess in the second end, whereby each clip can be inserted into position and removed therefrom independently of all the other clips, and without interfering with the mounting of the roller assembly or any of the parts thereof.

17. A roller assembly according to claim 16 and including a plurality of air tubes operative for directing air onto a film in the film plane, the air tubes including one associated with each of the rollers and positioned rearwardly of the respective roller, said air tubes constituting said means for supporting said second end of the breakaway clips.

18. A roller assembly according to claim 17 wherein each breakaway clip has at its said first end transversely extending fingers defining the recess at that end and that recess thereby extending transversely of the clip and opening through a side of the clip, whereby the clip is removable at its first end, as stated above, by moving the first end transversely of itself and transversely of the shaft of the roller, said recess at the first end extending slightly beyond 180° for normally retaining that end of the clip on the shaft of the roller, but enabling snapping of the clip from the shaft, the clip having at its said second end a pair of longitudinally extending fingers defining the said recess at that end, that recess opening longitudinally of the clip, that recess having an arcuate extent of 180° and the fingers extending in parallel direction beyond a diameter represented by the extremities of that arcuate extent, whereby each clip can be removed from said supporting means by withdrawing it longitudinally, after its said first end has been removed from the corresponding roller.

19. A film dryer comprising, a frame, a roller assembly mounted in the frame and including a plurality of pairs of rollers, each pair including a roller above and a roller below a common horizontal film plane extending from a front side to a rear side of the dryer, means operable for positively driving each of the rollers individually, and all of them in unison, and the driving means being operable for driving the rollers in each pair at the same peripheral speed, and those in successive pairs, progressing in direction from front to rear, at increasingly greater peripheral speeds, the rollers in each pair being in effective interengaging relation at said film plane and operable for gripping a film in that plane, and feeding it through the dryer from each pair of rollers to the next, from front to rear, and also for squeegeeing water from the film, whereby, due to the greater peripheral speeds of succeeding pairs of rollers, the rollers are operable for retaining the film in taut condition, and the dryer including means for directing a stream of air onto a film passing through the dryer.

20. A film dryer according to claim 19 wherein the rollers are of resilient material, and of successively greater diameters from front to rear, and the driving means is operable for driving all of the rollers at the same angular speed and whereby because of the increase in diameter of the successive rollers, the peripheral speeds of the rollers are increased progressively in the direction stated.

* * * * *